US007310985B2

(12) United States Patent
Thiel et al.

(10) Patent No.: US 7,310,985 B2
(45) Date of Patent: Dec. 25, 2007

(54) ROLLING DEVICE

(75) Inventors: Hermann Thiel, Siegen (DE); Christian Diehl, Hilchenbach (DE); Achim Klein, Kreuztal (DE)

(73) Assignee: SMS Demag AG, Düsseldorf (DE)

( * ) Notice: Subject to any disclaimer, the term of this patent is extended or adjusted under 35 U.S.C. 154(b) by 0 days.

(21) Appl. No.: 10/493,081

(22) PCT Filed: Oct. 10, 2002

(86) PCT No.: PCT/EP02/11324

§ 371 (c)(1),
(2), (4) Date: Sep. 20, 2004

(87) PCT Pub. No.: WO03/033183

PCT Pub. Date: Apr. 24, 2003

(65) Prior Publication Data

US 2005/0056069 A1 Mar. 17, 2005

(30) Foreign Application Priority Data

Oct. 17, 2001 (DE) ..... 101 50 690

(51) Int. Cl.
*B21B 31/07* (2006.01)

(52) U.S. Cl. ..... 72/247; 72/237; 72/241.8

(58) Field of Classification Search ..... 72/247
See application file for complete search history.

(56) References Cited

U.S. PATENT DOCUMENTS

| | | | | |
|---|---|---|---|---|
| 1,020,064 | A * | 3/1912 | Wackermann | 72/247 |
| 3,162,070 | A * | 12/1964 | Morgan et al. | 72/247 |
| 4,589,269 | A * | 5/1986 | Michaux | 72/247 |
| 4,813,256 | A * | 3/1989 | Engel | 72/13.4 |
| 4,907,439 | A * | 3/1990 | Diel et al. | 72/247 |
| 5,638,716 | A * | 6/1997 | Jonen | 72/241.8 |
| 6,244,090 | B1 * | 6/2001 | Le Viavant | 72/241.8 |

FOREIGN PATENT DOCUMENTS

JP 59085306 A * 5/1984

* cited by examiner

*Primary Examiner*—Derris H. Banks
*Assistant Examiner*—Debra M Wolfe
(74) *Attorney, Agent, or Firm*—Friedrich Kueffner

(57) ABSTRACT

A rolling device with at least two rolls installed in a common stand, the rolls being mounted on lateral stringers by bearings, which are able to move vertically along the lateral stringers, and with at least one axial adjusting device for one of the rolls. The axial adjusting device is directly assigned to the vertically adjustable bearings and is able to move vertically along with them.

6 Claims, 3 Drawing Sheets

ROLLING DEVICE

BACKGROUND OF THE INVENTION

The invention pertains to a rolling device with at least two rolls installed in a common stand, the rolls being mounted on lateral stringers by means of bearings which are able to move vertically along the lateral stringers.

These types of rolling devices can comprise in particular several mutually supporting rolls above and below the roll gap; these rolls can consist of a work roll, which comes into direct contact with the material to be rolled and also rolls either on a backup roll, which is usually larger than the work roll, or on an intermediate roll, which is itself supported on a backup roll. The work rolls and/or the backup rolls and/or the intermediate rolls can be designed so that they can be shifted with respect to each other in the axial direction. When the crowns are contoured, it is possible to have at least two rolls effective on the stock passing through the roll gap. The size of the roll gap should also be adjustable in this case, which means that it must be possible to shift the axial adjustment device vertically in the stand.

Especially in cases where a work roll bending device is provided in addition to the axial adjustment device, it is difficult to guarantee the desired adjustability even when the nip, that is, the size of the rolling gap, is large. The reason for this is that it is necessary not only to shift and to adjust the locking elements, which are integrated into the bending device which prevents the stock being rolled from bending the rolls which form the gap away from each other, but also to shift and to adjust the guide elements for the axial adjusting device and the bearings for the rolls in the lateral stringers of the stand. Each of these elements takes up a considerable amount of space, which means that, in cases where large rolling gaps can be realized, it is no longer possible to adjust the roll gap accurately to small values.

SUMMARY OF THE INVENTION

The invention is therefore based on the task of creating a rolling device with at least one axial adjusting device, where the rolling device, e.g., a device for rolling thick ingots or slabs, can also be adjusted to provide a roll gap of almost any desired size.

According to the invention, the overall design can be greatly simplified by integrating the axial adjusting device into the components which hold the bearings for one of the work rolls. As a result of this simplification, it is no longer necessary for the axial adjusting device to be capable of independent vertical adjustment.

Mounting the piston which produces the axial movement outside the roll stand makes it easier to replace the rolls. In addition, the geometric relationships become highly favorable.

BRIEF DESCRIPTION OF THE DRAWING

Additional advantages and features of the invention can be derived from an exemplary embodiment of the object of the invention, which is illustrated in the drawing and described below.

DETAILED DESCRIPTION OF THE INVENTION

Figure 1:
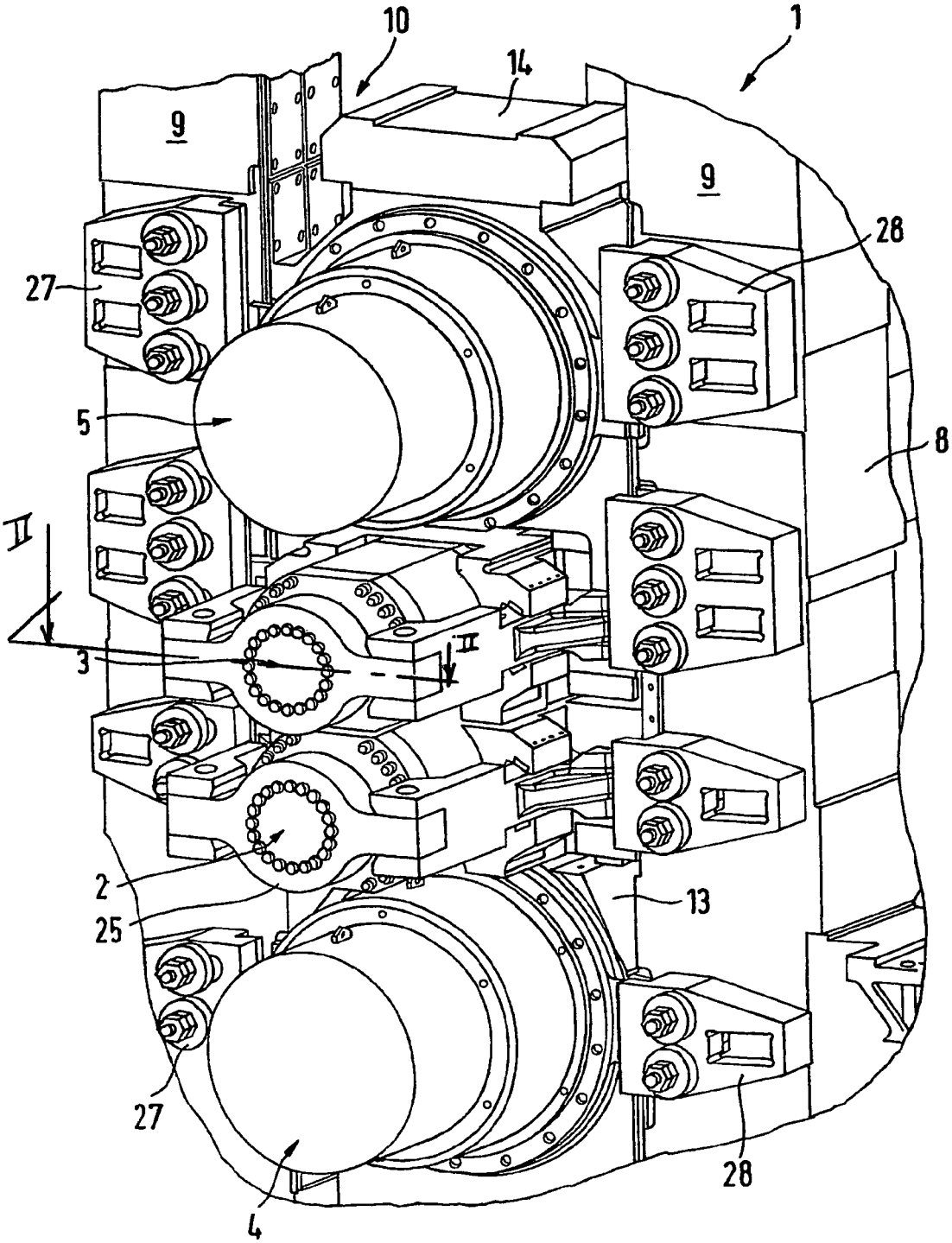
FIG. 1 shows a perspective view of two lateral stringers of a rolling device according to the invention with a pair of work rolls and a pair of backup rolls.
Figure 2:
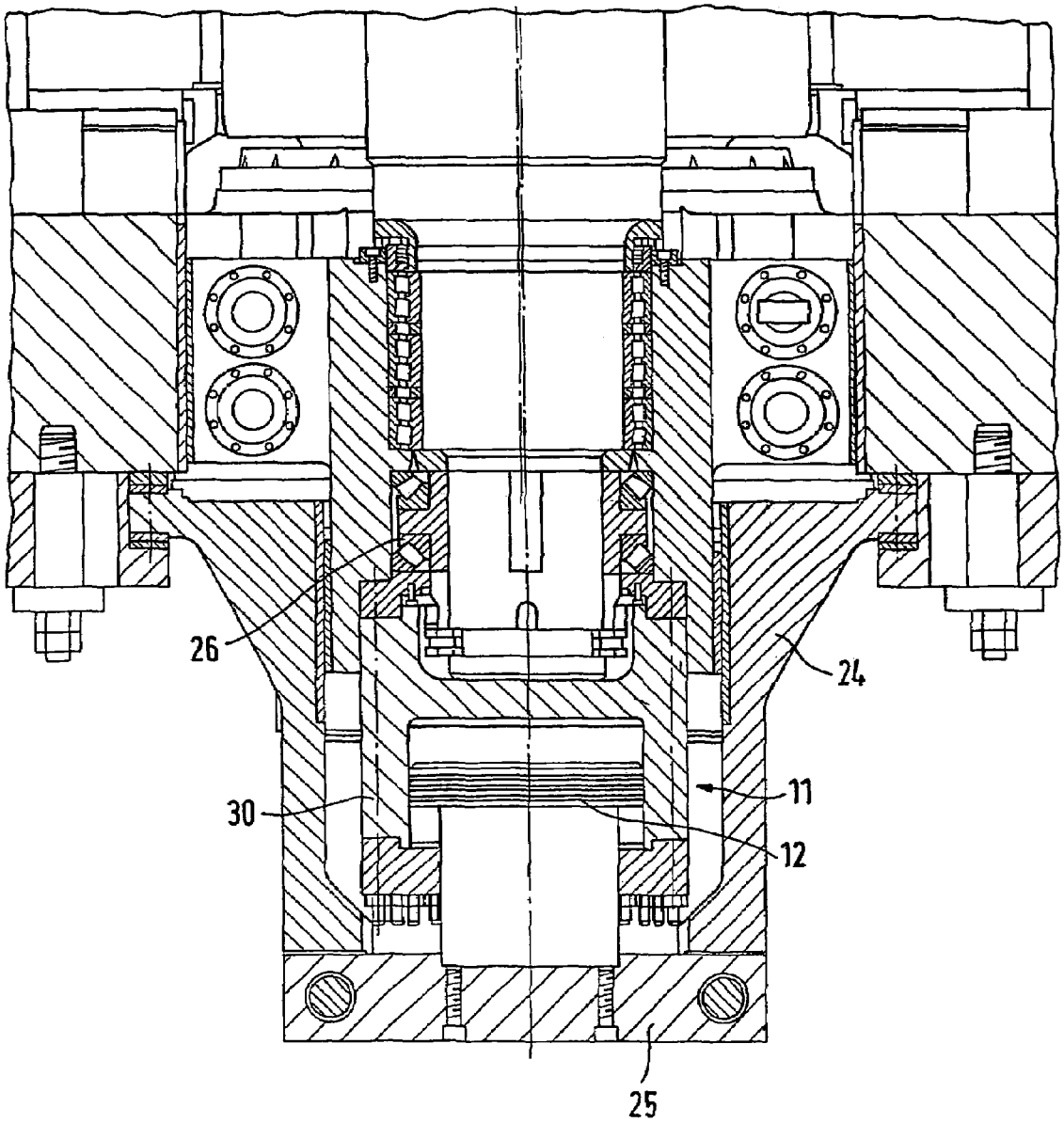
FIG. 2 shows a cross-sectional view of the inventive device according to FIG. 1 approximately along the plane II-II indicated in FIG. 1.

In the exemplary embodiment, a rolling device, designated overall by the reference number 1, is presented by way of example. This device is designed as a so-called four-high stand, comprising two work rolls 2, 3 and two backup rolls 4, 5. A different number of rolls is also possible; for example, a six-high stand with additional intermediate rolls between the work rolls 2, 3 and the backup rolls 4, 5 could be designed. The roll gap 6 for the material to be rolled is located between the two work rolls 2, 3. The size of this gap 6, the so-called nip, is adjustable.

The rolls 2, 3, 4, 5 are mounted in a stand 8. The stringers 9 of one of the pillars of the stand are shown. The stringers form the boundaries of a window 10, which serves as a guide for the vertical adjustability of the rolls 2, 3, 4, 5 and also allows the rolls to be replaced.

At least one of the work rolls 2, 3—usually more than one of the rolls—is adjustable in the axial direction. For this purpose, an axial adjusting device 11 is provided, which comprises a drive means, such as a piston 12, which is oriented in the axial direction of the roll 2, 3 and which represents an extension of the roll in question. The piston will be described in greater detail below.

The backup rolls 4, 5 are mounted on the stringers 9 by way of backup roll chocks 13, 14 at the edges of the window 10. To ensure that the backup rolls 4, 5—or at least the upper backup roll 5—can be adjusted vertically, the backup roll chocks 13, 14 are able to move in the vertically oriented slide rails 29 of lateral retaining devices 27, 28, which are attached to the stringers 9. The slide rails 29 are formed between the stringers 9 and projecting parts of the retaining devices 27, 28 and can be coated with a suitable friction-reducing material.

Figure 3:
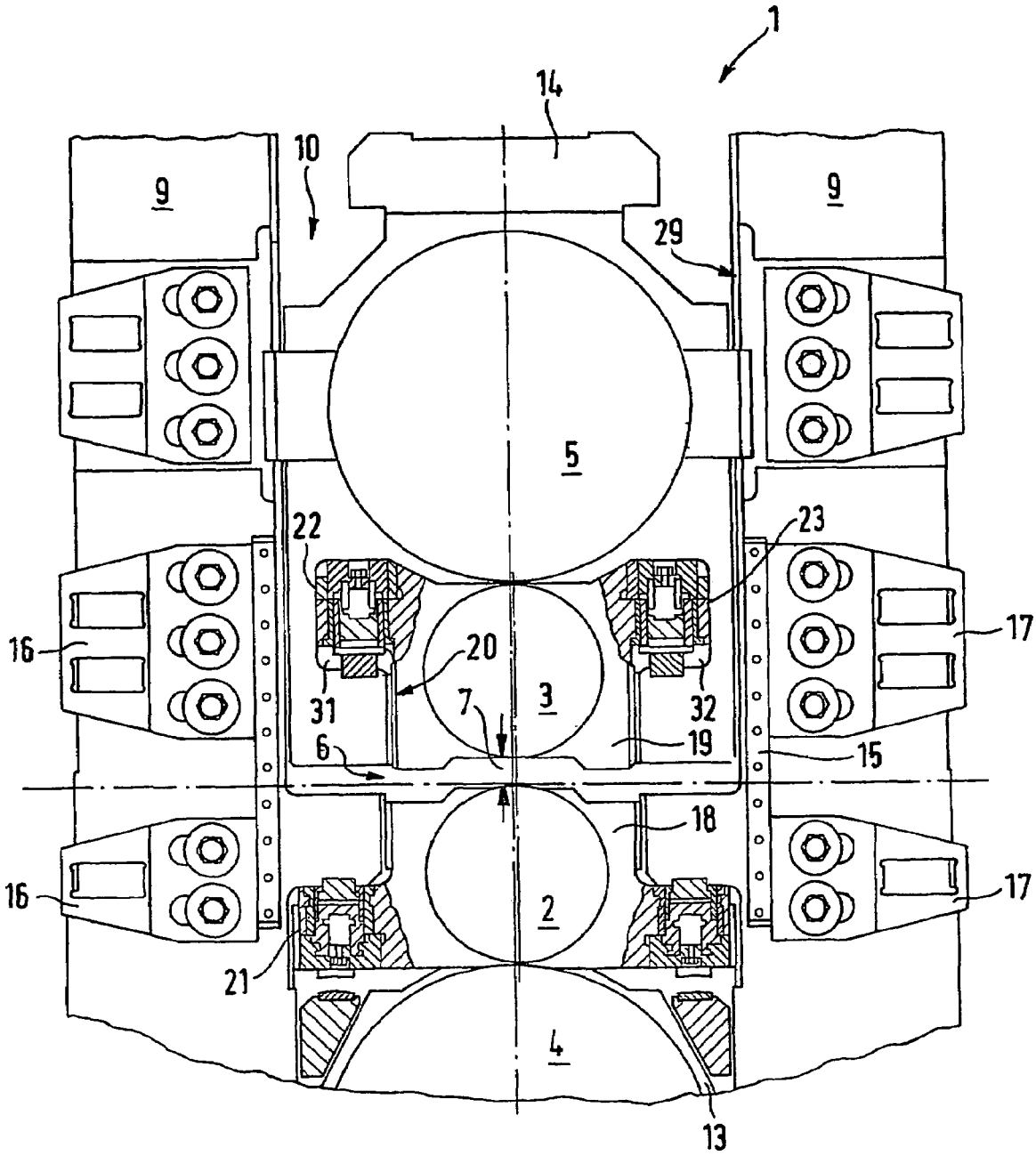
FIG. 3 shows a partial cutaway end view of the end surfaces of the rolls installed in the device according to FIG. 1.

The work rolls 2, 3 shown in the exemplary embodiment are supported by bearings 26 in the work roll chocks 18, 19. The work roll chocks 18, 19 are, at least in the case of the work roll 3 located above the roll gap 6, supported in U-shaped recesses 20 in the upper backup roll chocks 14 (FIG. 3). A solution of this type can also be provided for the lower work roll 2. Thus at least the upper work roll 3 is free to move vertically along with the backup roll 5. The height adjustment of the roll gap 6 is thus simplified. It also becomes easier to replace the rolls.

The bending device 22 is also installed with a vertical orientation in the recess 20. As an alternative, illustrated in FIG. 3, the bending device 22 could also be located in recesses 31, 32 in the backup roll chocks 14. This bending device 22, like the bending device 21 for the lower work roll 2, comprises thrust elements 23, one of which is assigned to each bearing end of a work roll 2, 3; these thrust elements act on the outer ends of the work rolls 2, 3, near their bearings 26, and thus exert a force directed vertically away from the roll gap 6 in correspondence with the force being exerted in the central area by the stock being rolled. This counterforce thus prevents the work rolls 2, 3 from being bent away from each other by the stock. The bending device 22 thus acts between the backup roll chock 14 on one side and the work roll chock 19 on the other side, so that there is no need for the bending device 22 to be supported by separate measures on the stringers 9.

The above-mentioned axial adjusting devices 11 are located at the other end areas of the work rolls 2, 3. The axial adjusting devices can be provided at one end, or, in the case of nondriven rolls, at both ends of a roll 2, 3. In the exemplary embodiment shown here, each of these devices comprises a horizontally oriented piston 12, which is located outside the stringers 9 on an extension of the roll axis.

As an alternative, it is also possible to provide several pistons, which are mounted horizontally and parallel to the roll axis. The piston 12 of the axial adjusting device 11 is mounted by way of an abutment 25 on bracket arms, which are designed to slide horizontally in the work roll chocks 18, 19. The bracket arms 24 are held by lateral retaining devices 16, 17, which are attached to the stringers 9 and which prevent the bracket arms 24 from moving horizontally in the direction of the roll axis. Thus the piston 12 of the axial adjusting device 11 is also fixed in the axial direction. The bracket arms 24 are able to move vertically in the slide rails 15 of the lateral retaining devices 16, 17.

It is also possible to use a different arrangement of the axial adjusting device 11, in which the cylinder housing 30 is mounted by way of an abutment 25 on the bracket arms 24 and is fixed in the axial direction by the lateral retaining devices 16, 17. The axial adjusting device 11 and the bearing 26 of the work roll 2, 3 are therefore integrated jointly into the work roll chocks 18, 19 and are able to move vertically in common. There is therefore no need for separate vertical adjusting means for the axial adjusting device 11.

In contrast to the exemplary embodiment, it is also possible to provide a lateral retaining device on each of the stringers 9 to hold both the backup roll chocks 13, 14 and the bracket arms 24 in place on the stringers 9.

The invention can be used for almost any number of rolls in a rolling device and for almost any geometric arrangement of these rolls.

LIST OF REFERENCE NUMBERS

1 rolling device
2 work roll
3 work roll
4 backup roll
5 backup roll
6 roll gap
7 height of the roll gap
8 stand
9 stringers
10 window
11 axial adjusting device
12 piston
13 backup roll chock
14 backup roll chock
15 slide rails
16 lateral retaining device
17 lateral retaining device
18 work roll chock
19 work roll chock
20 recess
21 bending device
22 bending device
23 thrust element of the bending device
24 bracket arm
25 abutment
26 bearing
27 lateral retaining device
28 lateral retaining device
29 slide rails
30 cylinder housing
31 recess
32 recess

The invention claimed is:

1. Rolling device (1) with at least two rolls (2, 3) installed in a common stand (8), the rolls being mounted on lateral stringers (9) by means of bearings (26), which are able to move vertically along the lateral stringers, and with at least one axial adjusting device (11) for one of the rolls (2, 3), wherein the axial adjusting device (11) is directly attached to the vertically adjustable bearings (26) and is able to move vertically along with them, wherein a work roll chock (18, 19) comprises an abutment (25) for a piston (12) of the axial adjusting device (11), which abutment is supported by a bracket arm (24) so that it can move with respect to the stand (8) in at least one vertical slide rail (15).

2. Rolling device according to claim 1, wherein the axial adjusting device (11) comprises at least one horizontally adjustable cylinder housing (30), which is mounted outside the stringers (9).

3. Rolling device according to claim 1, wherein the rolling device (1) comprises at least two backup rolls (4, 5) and two work rolls (2, 3), and in that both work rolls (2, 3) are axially adjustable.

4. Rolling device according to claim 3, wherein the backup rolls (4, 5) are supported in chocks (13, 14), which are vertically adjustable with respect to the stand (8).

5. Rolling device according to claim 4, wherein at least the work roll (3) forming the upper boundary of a roll gap (6) is mounted in the work roll chock (19), which is supported in the chock (14) of the backup roll (5).

6. Rolling device according to claim 1, wherein the supporting end of the bracket arm (24) is able to move in the slide rail (15).

* * * * *